US008801159B2

(12) United States Patent
Sugimoto

(10) Patent No.: US 8,801,159 B2
(45) Date of Patent: Aug. 12, 2014

(54) INK-JET RECORDING APPARATUS

(75) Inventor: Kiyoshi Sugimoto, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 435 days.

(21) Appl. No.: 13/075,318

(22) Filed: Mar. 30, 2011

(65) Prior Publication Data

US 2011/0242195 A1 Oct. 6, 2011

(30) Foreign Application Priority Data

Mar. 31, 2010 (JP) ..... 2010-082535

(51) Int. Cl.
*B41J 2/175* (2006.01)
*B41J 2/165* (2006.01)

(52) U.S. Cl.
CPC ..... *B41J 2/16511* (2013.01)
USPC ..... 347/86

(58) Field of Classification Search
USPC ..... 347/14, 86
See application file for complete search history.

(56) References Cited

U.S. PATENT DOCUMENTS

| | | | | |
|---|---|---|---|---|
| 7,111,922 | B2 * | 9/2006 | Morita | 347/35 |
| 2008/0165221 | A1 * | 7/2008 | Berry et al. | 347/32 |
| 2008/0284814 | A1 | 11/2008 | Chikamoto et al. | |

FOREIGN PATENT DOCUMENTS

| | | | | |
|---|---|---|---|---|
| JP | 61-043570 | | 3/1986 | |
| JP | 03-234623 | | 10/1991 | |
| JP | 03234634 | A * | 10/1991 | B41J 2/01 |
| JP | 04-016357 | | 1/1992 | |
| JP | 6-015831 | | 1/1994 | |
| JP | 06015831 | A * | 1/1994 | B41J 2/185 |
| JP | 09-085959 | | 3/1997 | |
| JP | 09085959 | A * | 3/1997 | B41J 2/185 |
| JP | 09-109403 | | 4/1997 | |
| JP | 2008-074038 | | 4/2008 | |

OTHER PUBLICATIONS

Notice of Reasons for Rejection issued in corresponding Japanese Patent Application No. 2010-082535, mailed Jul. 31, 2012.
First Office Action and Search Report issued in corresponding Chinese Application No. 201110083716.9 issued May 27, 2013.
Office Action dated Jan. 16, 2014, issued in corresponding Chinese Application No. 201110083716.9.

* cited by examiner

*Primary Examiner* — Laura Martin
(74) *Attorney, Agent, or Firm* — Banner & Witcoff, Ltd.

(57) ABSTRACT

An ink-jet recording apparatus may include a recording head comprising an ejection surface, a first wall configured to oppose the ejection surface, and a second wall configured to enclose surroundings of the ejection surface. The ink-jet recording apparatus may include a first wall moving unit which is configured to move the first wall between a first position and a second position. The ink-jet recording apparatus may include a second wall moving unit which is configured to move the second wall between a third position and a fourth position. An attitude of the first wall positioned at the second position and an attitude of the first wall at the first position are different. The first wall positioned at the first position and the second wall positioned at the third position form a closed space which covers the ejection port.

9 Claims, 6 Drawing Sheets

91
42
81a
85
81
82
80
35
82b
82a
43
99
87

92
42
88
86
43
81a
99
82a
82b
82
81
80
35

93
42
80
82
87
82b
35
86
43
99
81a
85
81
89

INK-JET RECORDING APPARATUS

CROSS REFERENCE TO RELATED APPLICATION

This application claims priority to Japanese Patent Application No. 2010-082535, filed Mar. 31, 2010, the entire subject matter and disclosure of which is incorporated herein by reference.

BACKGROUND OF THE DISCLOSURE

1. Field of the Disclosure

The features described herein relate to an ink-jet recording apparatus included in a facsimile machine, a copier, or a printer. More specifically, the features relate to a technique for covering an ink ejection surface of a recording head included in an ink-jet recording apparatus and sealing an ink ejection port.

2. Description of the Related Art

A known ink-jet recording apparatus includes a recording head including an ejection surface in which a plurality of ejection ports is formed. The recording head is configured to selectively eject ink through the ejection ports toward a recording sheet. When the ink-jet recording apparatus does not record information, the ejection surface of the recording head is covered with a cap to prevent drying of ink. The cap includes a plate member that opposes the ejection surface of the recording head and an annular lip that projects from the outer edge of the plate member and that is capable of coming into contact with the surroundings of the ejection surface, as illustrated in Japanese Unexamined Patent Application Publication No. 2008-74038. In order to miniaturize the size of the recording apparatus by minimizing the size of a space required for evacuation of the cap, a known ink-jet recording apparatus includes a cap that is configured to evacuate in the vicinity of a side of the recording head in a direction perpendicular to the ejection surface, as illustrated in Japanese Unexamined Patent Application Publication No. H09-109403.

The above-described cap has a thickness of the sum of the thickness of the plate member and the height of the projection of the annular lip. Therefore, evacuation of the cap in the vicinity of a side of the recording head and movement to the evacuation may need a space corresponding to at least the plate member and the annular lip, and such a space may impede miniaturization of the recording apparatus.

SUMMARY OF THE DISCLOSURE

According to an embodiment described herein, an ink-jet recording apparatus may include a recording head comprising an ejection surface in which an ejection port which is configured to eject ink toward a recording medium conveyed by a conveying member in a conveyance direction is formed. The ink-jet recording apparatus may include a first wall configured to oppose the ejection surface. The ink-jet recording apparatus may include a second wall configured to enclose surroundings of the ejection surface. The ink-jet recording apparatus may include a first wall moving unit which is configured to move the first wall between a first position at which the first wall opposes the ejection surface and a second position at which the first wall does not oppose the ejection surface. The ink-jet recording apparatus may include a second wall moving unit which is configured to move the second wall between a third position at which the second wall is in contact with the first wall positioned at the first position and a fourth position at which the second wall is not in contact with the first wall positioned at the first position. An attitude of the first wall positioned at the second position and an attitude of the first wall at the first position are different. The first wall positioned at the first position and the second wall positioned at the third position form a closed space which covers the ejection port.

In the above ink-jet recording apparatus, the closed space covering the ejection port is formed by at least the divided first and second walls. Accordingly, it is not necessary to provide the first wall with a protrusion for enclosing the surroundings of the ejection port of the ejection surface, such as a lip, thus enabling the first wall to have a reduced thickness. This can reduce the size of a space required for evacuation of the first wall at the second position, and the size of the ink-jet recording apparatus can be miniaturized.

BRIEF DESCRIPTION OF THE DRAWINGS

FIG. 3A illustrates a state where the recording head is positioned at a recording position, FIG. 3B illustrates a state where it is positioned at an inactive position, and FIG. 3C illustrates a state where it is positioned at an evacuation position.

DESCRIPTION OF THE EMBODIMENTS

Various embodiments, and their features and advantages, may be understood by referring to FIGS. 1-6, like numerals being used for corresponding parts in the various drawings.

Figure 1:
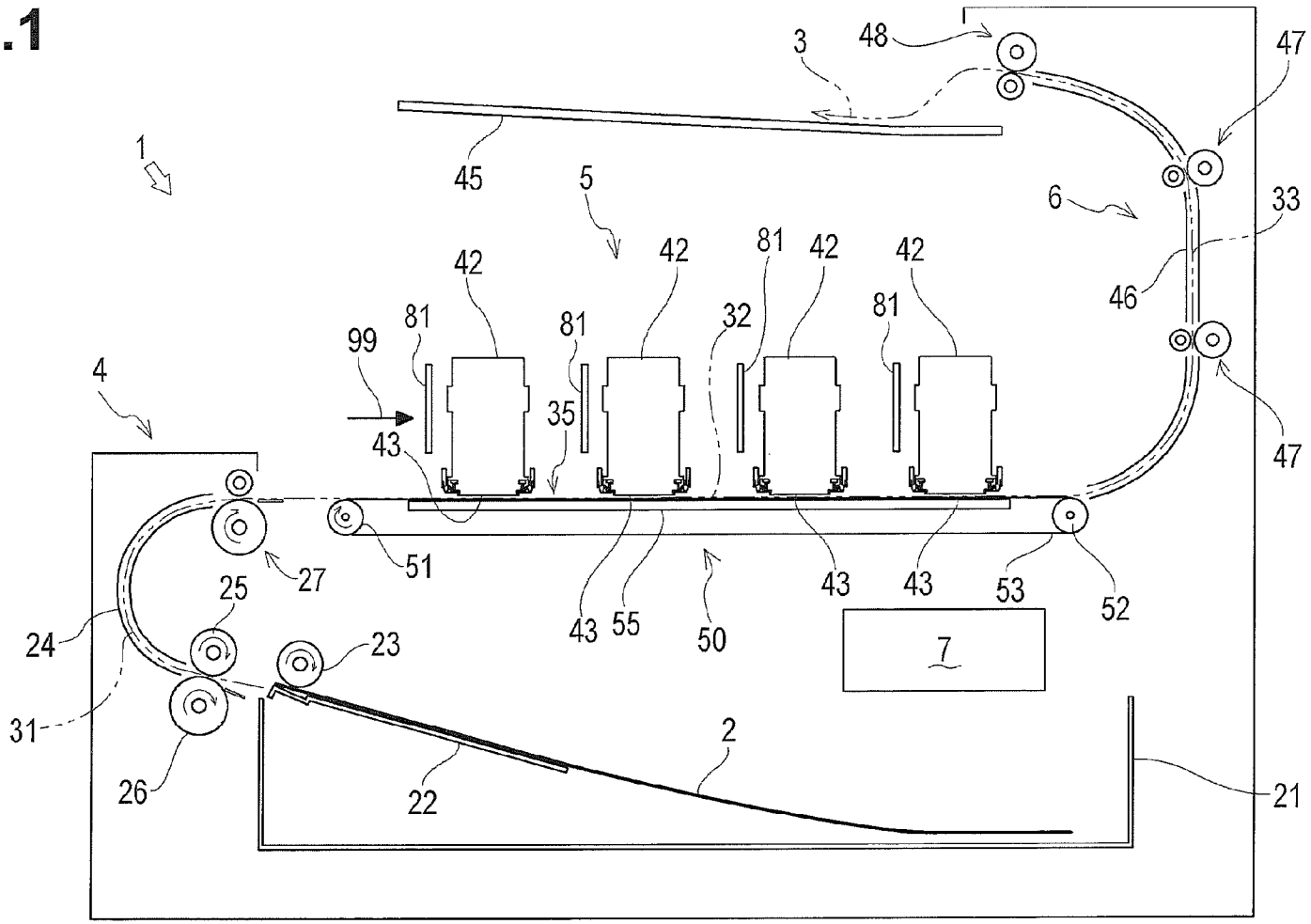
FIG. 1 is a side view that schematically illustrates a configuration of an ink-jet recording apparatus according to an embodiment.

Referring to FIG. 1, a general configuration of an ink-jet recording apparatus according to an embodiment is described. In FIG. 1, a paper feed case 21, recording heads 42, and other elements are illustrated in cross section, but hatching is omitted. The ink-jet recording apparatus 1 is a line color ink-jet recording apparatus including four line recording heads for four colors of black, cyan, magenta, and yellow. The ink-jet recording apparatus 1 includes a recording device 5 for recording information on a recording sheet 2 being a recording medium, a paper feed device 4 for feeding the recording sheet 2 to the recording device 5, a paper output device 6 for discharging the recording sheet 2 from the recording device 5, and a control device 7 for controlling operations of the above-described devices. The control device 7 can be configured to include a microcomputer, for example, as in a typical ink-jet recording apparatus. The ink-jet recording apparatus 1 records information on the recording sheet 2 being conveyed along a conveyance route 3 including a paper feed path 31 disposed in the paper feed device 4, a conveyance path 32 disposed in the recording device 5, and a paper output path 33 disposed in the paper output device 6. In FIG. 1, the conveyance route 3 is indicated by the dash-dot-dot line.

The paper feed device 4 includes the detachable cassette-type paper feed case 21 for holding the recording sheets 2 and the paper feed path 31 along which the recording sheets 2 are fed from the paper feed case 21 to the recording device 5. In the paper feed case 21, the recording sheets 2 are stacked substantially vertically, and each of the recording sheets 2 is picked up from the paper feed case 21 and transported to the paper feed path 31. The upstream end of the paper feed path 31 is positioned at one end of the paper feed case 21 (the left-hand side in FIG. 1). The paper feed case 21 is provided with a plate paper feed guide 22 so as to be connected to the upstream end of the paper feed path 31. A pickup roller 23 is disposed above the paper feed guide 22. The pickup roller 23 has a circumferential surface that opposes the paper feed guide 22. The pickup roller 23 is movable toward or away from the paper feed guide 22. When the ink-jet recording apparatus 1 is in operation, the pickup roller 23 is pressed in contact with a section of the uppermost recording sheet 2 held in the paper feed case 21, the section being placed on the paper feed guide 22. In this state, when the pickup roller 23 rotates, the recording sheet 2 pinched between the pickup roller 23 and the paper feed guide 22 is picked up from the paper feed case 21 and transported to the paper feed path 31.

The paper feed path 31 includes a plurality of paper feed side guides 24 and a plurality of rollers by which the recording sheet 2 is transported along the paper feed side guides 24. The recording device 5 is disposed immediately above the paper feed case 21, and the paper feed path 31 has a substantially semicircular shape in side view formed from the paper feed side guides 24 extending from the paper feed guide 22 toward the recording device 5.

A pair of rollers 25 and 26 having circumferential surfaces opposing each other are disposed in the upstream section of the paper feed path 31. The paper feed path 31 is disposed between the rollers 25 and 26. The pair of rollers 25 and 26 are the feed roller 25 and the retard roller 26. The feed roller 25 rotates so as to transport the recording sheet 2 in a paper feed direction (i.e., downstream in the paper feed path 31). The retard roller 26 includes a torque limiter. When a single recording sheet 2 is transported, the retard roller 26 rotates in coordination with rotation of the feed roller 25. In contrast, when two or more recording sheets 2 are transported, the retard roller 26 rotates so as to transport the recording sheets 2 in a direction opposite to the paper feed direction. The recording sheet 2 on the paper feed path 31 is transported in the paper feed direction while being pinched between the circumferential surfaces of the rotating feed roller 25 and retard roller 26. At this time, even if a plurality of recording sheets 2 are picked up from the paper feed case 21, only one recording sheet 2 is separated and transported in the paper feed direction by the action of the pair of rollers 25 and 26.

A pair of registration rollers 27 having circumferential surfaces opposing each other are disposed in the downstream section of the paper feed path 31. The paper feed path 31 is disposed between the registration rollers 27. The pickup roller 23, feed roller 25, retard roller 26, and registration rollers 27 are driven by a single paper feed motor (not illustrated) so as to rotate. The recording sheet 2 is transported in the paper feed direction while being pinched between the circumferential surfaces of the rotating registration rollers 27 and fed to the conveyance path 32 in a state where its attitude and orientation are arranged. In the paper feed path 31 downstream of the registration rollers 27 and the conveyance path 32, the recording sheet 2 conveyed in the conveyance route 3 is moved in a conveyance direction (the direction indicated by the arrow 99 in FIG. 1).

The recording device 5 includes the conveyance path 32 connected to the downstream end of the paper feed path 31 in the paper feed device 4 and the plurality of recording heads 42 disposed along the conveyance path 32. In the conveyance path 32, the recording sheet 2 is conveyed along the conveyance direction.

The conveyance path 32 includes a belt conveying device 50. The belt conveying device 50 includes a driving roller 51, a driven roller 52, an endless belt 53 wound around the driving roller 51 and the driven roller 52, and a motor (not illustrated) for driving the driving roller 51 to rotate. The rotating shaft of the driving roller 51 and that of the driven roller 52 are spaced away from each other in the conveyance direction 99. The endless belt 53 between the driving roller 51 and the driven roller 52 forms the conveyance path 32; the section adjacent to the driving roller 51 is the upstream section of the conveyance path 32 and the section adjacent to the driven roller 52 is the downstream section of the conveyance path 32. An upper surface of the endless belt 53 forming the conveyance path 32 is a conveying surface 35 for use in conveying the recording sheet 2 placed thereon. The recording sheet 2 is conveyed on the conveying surface 35 along the conveyance direction 99. To maintain horizontality of the conveying surface 35, a platen 55 supporting the endless belt 53 from below is disposed between the driving roller 51 and the driven roller 52. The platen 55 supports the endless belt 53 using its plane substantially parallel with the conveying surface 35.

The plurality of, e.g., four, recording heads 42 are disposed above the conveying surface 35. The recording heads 42 for ejecting black, cyan, magenta, and yellow inks, are arranged in sequence from the upstream side in the conveyance path 32 along the conveyance direction 99. Each of the recording heads 42 includes an ejection surface 43 opposing the conveying surface 35 of the endless belt 53. The recording head 42 has ejection ports of a plurality of nozzles opened in the ejection surface 43 and selectively ejects ink toward the recording sheet 2 conveyed on the conveying surface 35 through the ejection ports.

The paper output device 6 includes a paper output tray 45 and the paper output path 33 connected to the downstream end of the conveyance path 32. The recording sheet 2 transport from the conveyance path 32 to the paper output path 33 is discharged to the paper output tray 45 along the paper output path 33. The paper output path 33 includes a plurality of paper output side guides 46, a plurality of pairs of discharge rollers 47 for transporting the recording sheet 2 along the paper output side guides 46, and a pair of paper output rollers 48 for outputting the recording sheet 2 transported along the paper output path 33 to the paper output tray 45. The paper output tray 45 is disposed above the recording device 5, and the paper output path 33 has a substantially semicircular shape in side view formed from the paper output side guides 46 extending from the downstream end of the conveyance path 32 toward the paper output tray 45.

The ink-jet recording apparatus 1 having the above-described configuration operates so as to pick up the recording sheet 2 from the paper feed case 21 and transport it along the paper feed path 31 at the paper feed device 4 to feed it to the recording device 5, records information on the recording sheet 2 by applying ink thereon while conveying it along the conveyance path 32 at the recording device 5, and discharges the recording sheet 2 with the information recorded thereon to the paper output tray 45 along the paper output path 33 at the paper output device 6. This series of operations of the ink-jet recording apparatus 1 is controlled by the control device 7.

Figure 2:
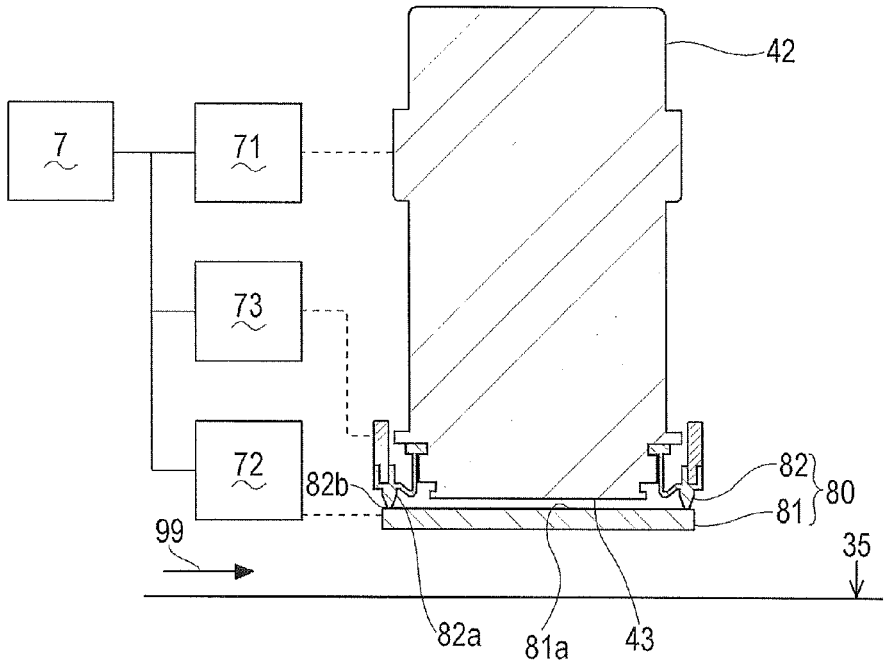
FIG. 2 is a side cross-sectional view that schematically illustrates a configuration of a recording head and a cap.

Referring to FIG. 2, the recording head 42 includes a plurality of nozzles, an ejection actuator (not illustrated) provided to each of the nozzles to cause ink to be ejected through the ejection port of the nozzle, and an ink reservoir (not illustrated) for receiving ink supplied from an ink tank through an ink channel. Each nozzle communicates with the ink reservoir. The ejection port of the nozzle is open in the ejection surface 43, which is the lower surface of the recording head 42. The ejection surface 43 opposes the conveying surface 35, on which the recording sheet 2 is conveyed. The recording head 42 is fixed during recording. Accordingly, a region of the ejection surface 43 that has the ejection ports formed therein is the region in which ink droplets are ejected toward the recording sheet 2 during recording. In order to enable ink droplets to be ejected across the full recording width of the conveyed recording sheet 2 (size in which information is recordable in a direction substantially perpendicular to the conveyance direction 99 (a direction in and out of the page in FIG. 1)), the ejection surface 43 has a depth (a size in a direction substantially perpendicular to the conveyance direction 99) that is equal to or more than the recording width of the recording sheet 2 and has a plurality of ejection ports arranged in an array having rows extending along the depth direction. That is, the recording head 42 is configured as a line recording head. Thus, the recording head 42 also has a depth equal to or more than the recording width of the recording sheet 2 and has the shape of a substantially rectangular parallelepiped that is long in the depth direction.

The recording head 42 having the above-described configuration ejects ink droplets toward the recording sheet 2 conveyed on the conveying surface 35 along the conveyance direction 99 in the conveyance path 32. Forming an image, for example, by the ink droplets attached to the recording sheet 2 is recording information on the recording sheet 2. During non-recording, such as when the ink-jet recording apparatus 1 is at a standstill or in maintenance, the recording head 42 does not eject ink droplets. In order to prevent ink on a plurality of ejection ports exposed in the ejection surface 43 of the recording head 42 from drying during such non-recording, the ejection surface 43 is covered with a cap 80 for collectively surrounding a plurality of ejection ports. An inner space formed between the ejection surface 43 and the cap 80 is sealed, thus sealing the ejection ports in the ejection surface 43. The cap 80 can cover the ejection surface 43 of the recording head 42 and receive a very small quantity of ink droplets ejected through the ejection ports during a recovery operation (purge) for the nozzles. Normally, the ejection surface 43 during non-recording is in a capped state where it is covered with the cap 80, whereas the ejection surface 43 during recording is in an uncapped state where it is not covered with the cap 80.

Figures 3A, 3B, 3C:
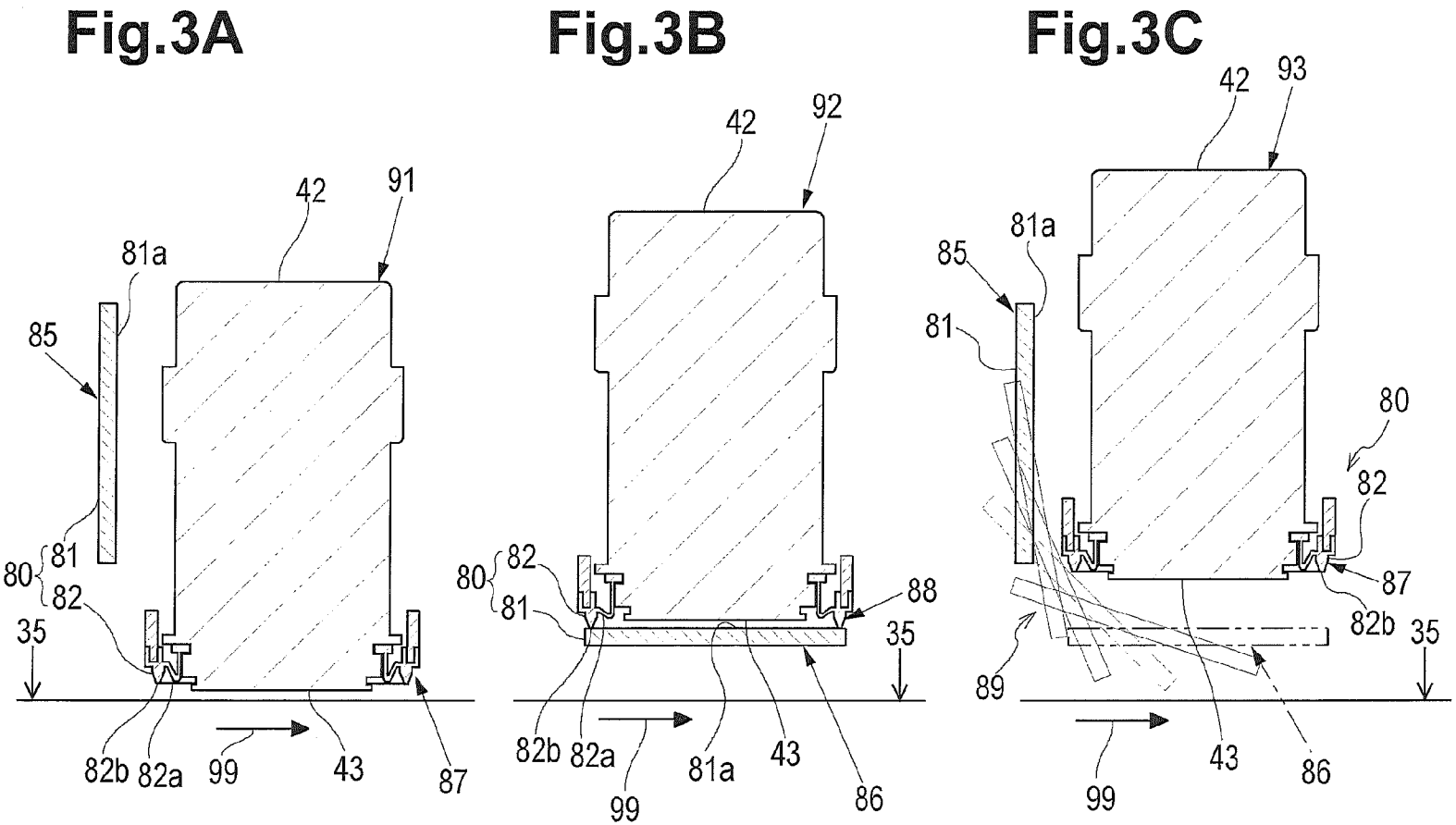
FIGS. 3A to 3C illustrate how the recording head and the cap move.

Referring to FIGS. 3A to 3C, in addition to FIG. 2, the cap 80 includes at least two elements of a first wall 81 and a second wall 82. In a capped state illustrated in FIGS. 2 and 3B, the first wall 81 covers a section that opposes the ejection surface 43 of the recording head 42, and the second wall 82 covers the surroundings of the ejection surface 43. The first wall 81 includes a cap surface 81*a* capable of opposing the ejection surface 43. The second wall 82 includes an inner surface 82*a* capable of collecting surrounding a plurality of ejection ports of the ejection surface 43. In a capped state, the cap surface 81*a* of the first wall 81 and the lower end of the second wall 82 are in contact with each other with no gap therebetween. This forms a sealed space among the cap surface 81*a* of the first wall 81, the inner surface 82*a* of the second wall 82, and the ejection surface 43.

The cap surface 81*a* included in the first wall 81 of the cap 80 has a size and shape at which it can cover a region equal to or larger than the ejection surface 43 of the recording head 42. The lower end of the second wall 82 comes into contact with the cap surface 81*a* of the first wall 81. At least some section of the cap surface 81*a* with which the second wall 82 comes into contact is made of resin material to enhance sealing. An absorber for absorbing ink that dripped from the ejection ports or ink ejected in a recovery operation can be provided to the cap surface 81*a*. The first wall 81 is movable to an evacuation position 85 at which the first wall 81 is evacuated from between the ejection surface 43 of the recording head 42 and the conveying surface 35 of the endless belt 53 (see FIGS. 3A and 3C) and to a capping position 86 between the ejection surface 43 and the conveying surface 35 (see FIGS. 3B and 3C). The first wall 81 is movable to the evacuation position 85 and the capping position 86 by a first wall moving actuator 72 (see FIG. 2). The first wall moving actuator 72 operates under the control of the control device 7.

The first wall 81 at the evacuation position 85 is positioned at a side of the recording head 42 and distant from the recording head 42 at the upstream or downstream section in the conveyance direction 99. The distance between the first wall 81 at the evacuation position 85 and the conveying surface 35 is longer than that between the ejection surface 43 of the recording head 42 and the conveying surface 35. The cap surface 81*a* of the first wall 81 at the evacuation position 85 opposes the recording head 42. Because being remote from and higher than the ejection surface 43 with reference to the conveying surface 35, the first wall 81 at the evacuation position 85 does not hinder movement of the recording sheet 2 conveyed on the conveying surface 35 and motion of ink droplets ejected through the ejection surface 43 of the recording head 42. In addition to this, because the cap surface 81*a* at the evacuation position 85 is in an attitude substantially perpendicular to the conveyance direction 99, the size of a space required for the first wall 81 at the evacuation position 85 in the conveyance direction 99 can be smaller than that occurring when the cap surface 81*a* is parallel with the conveyance direction 99.

When the first wall 81 is positioned at the capping position 86, the cap surface 81*a* opposes the ejection surface 43 of the recording head 42. A plane that contains the cap surface 81*a* of the first wall 81 at the evacuation position 85 and a plane that contains the cap surface 81*a* of the first wall 81 at the capping position 86 are substantially perpendicular to each other. The ejection surface 43 of the recording head 42 is substantially parallel with the conveying surface 35, and both the ejection surface 43 and the conveying surface 35 are substantially parallel with the conveyance direction 99. Accordingly, the first wall 81 is moved between the evacuation position 85 and the capping position 86 while its attitude is changed in such a way that the orientation of the cap surface 81*a* changes from being substantially perpendicular to the conveyance direction 99 to being substantially parallel therewith. There can be a plurality of loci of the first wall 81 for the above-described movement. Examples of such loci include a locus 89 having an approximately L shape in side view indicated by the thin lines illustrated in FIG. 3C and a locus having an approximately arc shape in side view.

The second wall 82 of the cap 80 has a tubular shape that encloses the surroundings of the ejection surface 43 of the recording head 42. Because the second wall 82 has a shape that encloses the surroundings of the ejection surface 43, it is not necessary to provide adjacent areas of a plurality of ejection ports in the ejection surface 43 of the recording head 42 with a base with which the second wall 82 comes into contact, and the ejection ports can be arranged up to the edge of the ejection surface 43. Accordingly, the size of the ejection surface 43 of the recording head 42 can be reduced, and this can contribute to miniaturization of the recording head 42 and thus miniaturization of the recording apparatus.

The second wall 82 is an elastically deformable body having a tubular shape. The upper end section of the second wall 82 is fixed above the ejection surface 43 around the recording head 42. The second wall 82 has a lower end section 82*b* (an end adjacent to the conveying surface 35) being a free end. The lower end section 82*b* of the second wall 82 is movable in relation to the ejection surface 43 of the recording head 42 to an evacuation position 87 positioned at a side of the ejection surface 43 of the recording head 42 (see FIGS. 3A and 3C) and to a capping position 88 at which the distance between the lower end section 82*b* and the conveying surface 35 is shorter than that between the ejection surface 43 and the conveying surface 35 (see FIG. 3B). The lower end section 82*b* of the second wall 82 at the evacuation position 87 is at a position having substantially the same height as the ejection surface 43 or higher than the ejection surface 43 remote from the conveying surface 35. This enables the locus of the first wall 81 to pass through a location nearer to the recording head 42. Alternatively, the lower end section 82*b* of the second wall 82 at the evacuation position 87 can slightly protrude beyond the ejection surface 43 toward the conveying surface 35. The lower end section 82*b* of the second wall 82 at the capping position 88 is in contact with the cap surface 81*a* of the first wall 81 at the capping position 86. The lower end section 82*b* of the second wall 82 is movable to the evacuation position 87 and the capping position 88 by a second wall moving actuator 73 (see FIG. 2). The second wall moving actuator 73 operates under the control of the control device 7.

In moving the lower end section 82*b* of the second wall 82 from the capping position 88 to the evacuation position 87, the second wall moving actuator 73 elastically deforms the second wall 82 so as to fold it. In moving the lower end section 82*b* of the second wall 82 from the evacuation position 87 to the capping position 88, the second wall moving actuator 73 elastically deforms the second wall 82 so as to restore the folded second wall 82. That is, the lower end section 82*b* of the second wall 82 moves substantially linearly toward or away from the conveying surface 35, and the amount of the movement is only several millimeters. Accordingly, both a space required for the existence of the second wall 82 and a space required for movement of the second wall 82 from the evacuation position 87 to the capping position 88 can have a reduced size. The second wall 82 having such characteristics is not limited to the above-described example. For example, the second wall 82 may have an accordion tubular shape substantially vertically extendable and shrinkable, another tubular shape substantially vertically extendable and shrinkable, a tubular shape that cannot be elastically deformed but has a sufficient length slide-able substantially vertically with respect to the recording head 42, or may be made up of a plurality of members.

In order to further reduce the above-described space required for movement of the first wall 81 of the cap 80, the recording head 42 may be movable in part or in entirety to enable the ejection surface 43 of the recording head 42 to be moved toward or away from the conveying surface 35. In the ink-jet recording apparatus 1, the recording head 42 is movable in entirety substantially vertically so as to allow the ejection surface 43 to be movable toward or away from the conveying surface 35, and a head moving actuator 71 for moving the recording head 42 in this way is included (see FIG. 2). The head moving actuator 71 operates under the control of the control device 7.

The head moving actuator 71 can move the recording head 42 among a recording position 91 at which the conveying surface 35 and the ejection surface 43 are near to each other while allowing the recording sheet 2 to be inserted therebetween (see FIG. 3A), an inactive position 92 at which the conveying surface 35 and the ejection surface 43 are separated from each other while allowing the first wall 81 to be inserted therebetween (see FIG. 3B), and an evacuation position 93 at which the conveying surface 35 and the ejection surface 43 are more separated from each other than that at the inactive position 92 (see FIG. 3C). The recording position 91 is a position where in a movable range of the recording head 42 the ejection surface 43 is nearest to the conveying surface 35, and the distance between the ejection surface 43 and the conveying surface 35 at this position is approximately 0.5 mm to 1.0 mm. The movement stroke from the recording position 91 to the evacuation position 93 is approximately 20 mm.

Figure 4:
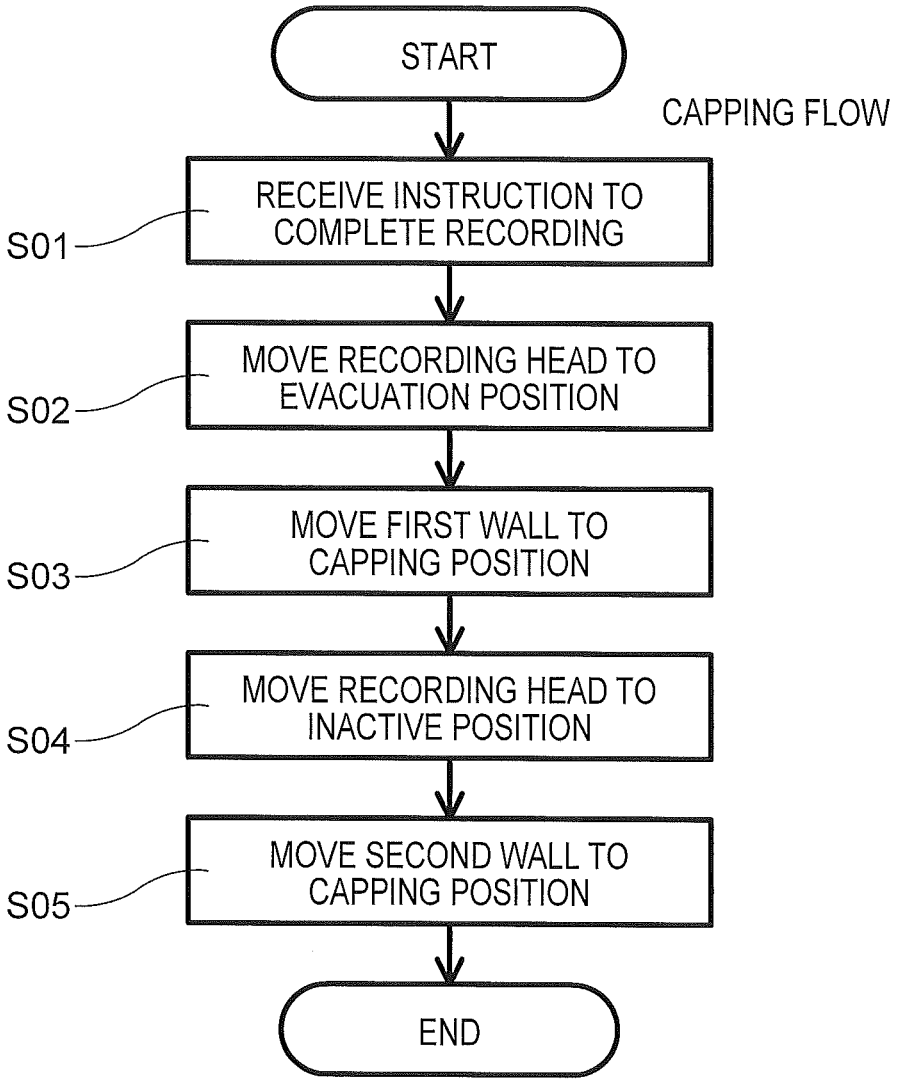
FIG. 4 is a flowchart of a capping process.

Referring to FIG. 4, a flow of a process of control performed by the control device 7 occurring when the ejection surface 43 of the recording head 42 is capped is described. The initial situation is the ink-jet recording apparatus 1 being during recording and the recording head 42 being in an uncapped state illustrated in FIG. 3A. Specifically, the recording head 42 is positioned at the recording position 91, the first wall 81 of the cap 80 is at the evacuation position 85, and the lower end section 82*b* of the second wall 82 is at the evacuation position 87.

When recording on the recording sheet 2 is completed and an instruction to complete recording is input to the control device 7 (step S01), the control device 7 causes the head moving actuator 71 to move the recording head 42 from the recording position 91 to the evacuation position 93 (step S02) (see FIG. 3C). Then, the control device 7 causes the first wall moving actuator 72 to move the first wall 81 from the evacuation position 85 to the capping position 86 (step S03). When the first wall 81 reaches the capping position 86, the control device 7 causes the head moving actuator 71 to move the recording head 42 from the evacuation position 93 to the inactive position 92 (step S04). When the recording head 42 reaches the inactive position 92, the control device 7 causes the second wall moving actuator 73 to move the lower end section 82*b* of the second wall 82 from the evacuation position 87 to the capping position 88 (step S05) (see FIG. 3B). Through steps S01 to S05, the ejection surface 43 of the recording head 42 can be covered with the cap 80 including the first wall 81 and the second wall 82.

In order to reduce the time required for a capping operation, in step S05, without waiting for the arrival of the recording head 42 on the inactive position 92, the lower end section 82*b* of the second wall 82 may start being moved, and at substantially the same time or after the recording head 42 reaches the inactive position 92, the lower end section 82*b* of the second wall 82 may reach the capping position 88.

Figure 5:
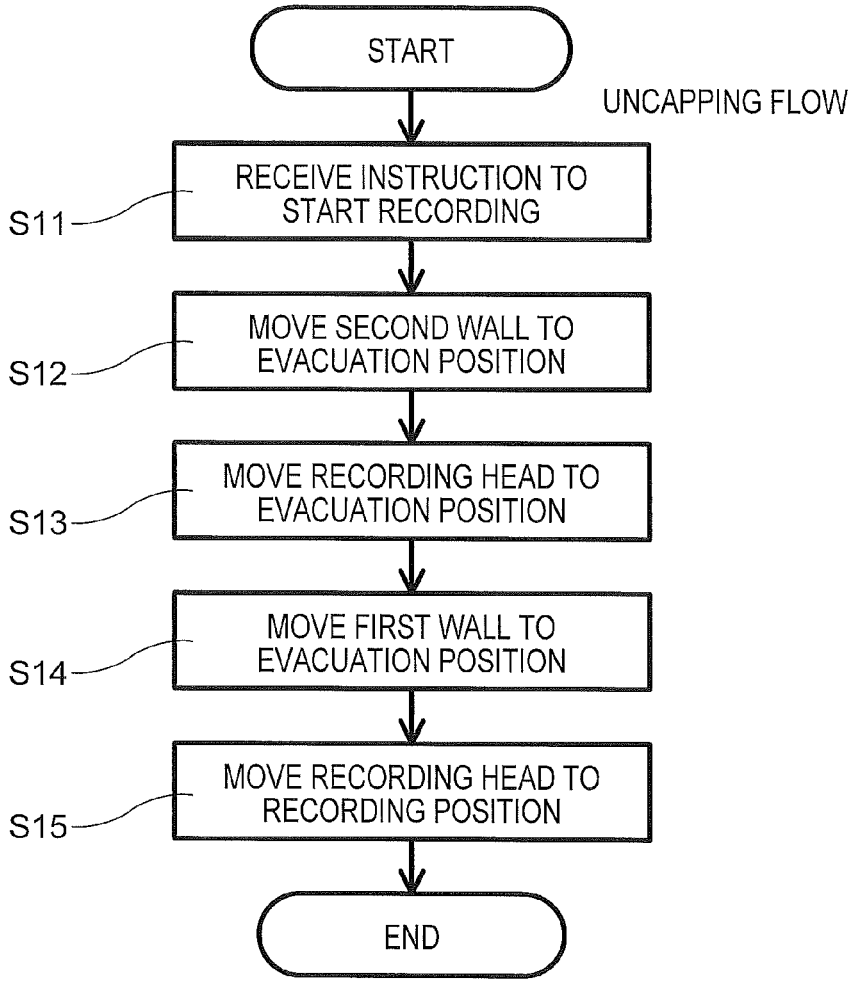
FIG. 5 is a flowchart of an uncapping process.

Referring to FIG. 5, a flow of a process of control performed by the control device 7 occurring when the ejection surface 43 in a capped state illustrated in FIG. 3B is uncapped. The initial situation is the ink-jet recording apparatus 1 being during non-recording, such as being inactive or in a recovery operation, the recording head 42 being at the inactive position 92, the first wall 81 of the cap 80 being at the capping position 86, and the lower end section 82*b* of the second wall 82 being at the capping position 88.

When an instruction to start recording is input to the control device 7 (step S11), the control device 7 causes the second wall moving actuator 73 to move the lower end section 82*b* of the second wall 82 from the capping position 88 to the evacuation position 87 (step S12). Subsequently, the control device 7 causes the head moving actuator 71 to move the recording head 42 from the inactive position 92 to the evacuation position 93 (step S13) (see FIG. 3C). When the recording head 42 reaches the evacuation position 93, the control device 7 causes the first wall moving actuator 72 to move the first wall 81 from the capping position 86 to the evacuation position 85 (step S14). When the first wall 81 reaches the evacuation position 85, the control device 7 causes the head moving actuator 71 to move the recording head 42 from the evacuation position 93 to the recording position 91 (step S15) (see FIG. 3A). Through steps S11 to S15, covering the ejection surface 43 of the recording head 42 with the cap 80 is removed, and the recording apparatus becomes ready for recording.

In order to reduce the time required for an uncapping operation, in step S13, without waiting for the arrival of the lower end section 82*b* of the second wall 82 on the evacuation position 87, the recording head 42 may start being moved from the inactive position 92 toward the evacuation position 93. Moreover, in step S14, without waiting for the arrival of the recording head 42 on the evacuation position 93, the first wall 81 may start being moved from the capping position 86 toward the evacuation position 85.

As described above, in the ink-jet recording apparatus 1 according to the embodiment, the cap 80 capable of forming a sealed space covering the ejection surface 43 includes a plurality of, e.g., two, elements of the first wall 81 capable of opposing the ejection surface 43 of the recording head 42 and the second wall 82 capable of covering the surroundings of the ejection surface 43. That is, the bottom section of the cap 80 is the first wall 81, and the side wall section thereof is the second wall 82. Because the cap 80 includes a plurality of, e.g., two, divided elements as described above, it is not necessary to provide the first wall 81 with a projection, such as a lip, that encloses the surroundings of the ejection surface 43. Accordingly, the first wall 81 can have a reduced thickness. Thus, in an uncapped state during recording, both a space required for the evacuation of the first wall 81 at the evacuation position 85 and a space required to move the first wall 81 between the evacuation position 85 and the capping position 86 can have a reduced size. The recording head 42 is positioned at the evacuation position 93, where the distance to the conveying surface 35 is longer than that occurring at the inactive position 92, while the first wall 81 is moved from the evacuation position 85 to the capping position 86. This movement of the recording head 42 to the evacuation position 93 allows the first wall 81 to be moved between the recording head 42 at the inactive position 92 and that at the evacuation position 93 as illustrated in FIG. 3C. This can reduce the radius of rotation for changing the attitude contained in the movement of the first wall 81 between the evacuation position 85 and the capping position 86 and vice versa. Accordingly, the size of the space required for movement of the first wall 81 between the evacuation position 85 and the capping position 86 can be reduced. In this way, reduction in the size of the space required for the first wall 81 (in particular, its size in the conveyance direction 99) can contribute to miniaturization of the ink-jet recording apparatus 1. In particular, because the ink-jet recording apparatus 1 includes the plurality of recording heads, a reduction in the size of a space for a single set of the cap 80 for each of the recording heads 42 enables the entire apparatus to be markedly miniaturized.

Figure 6:
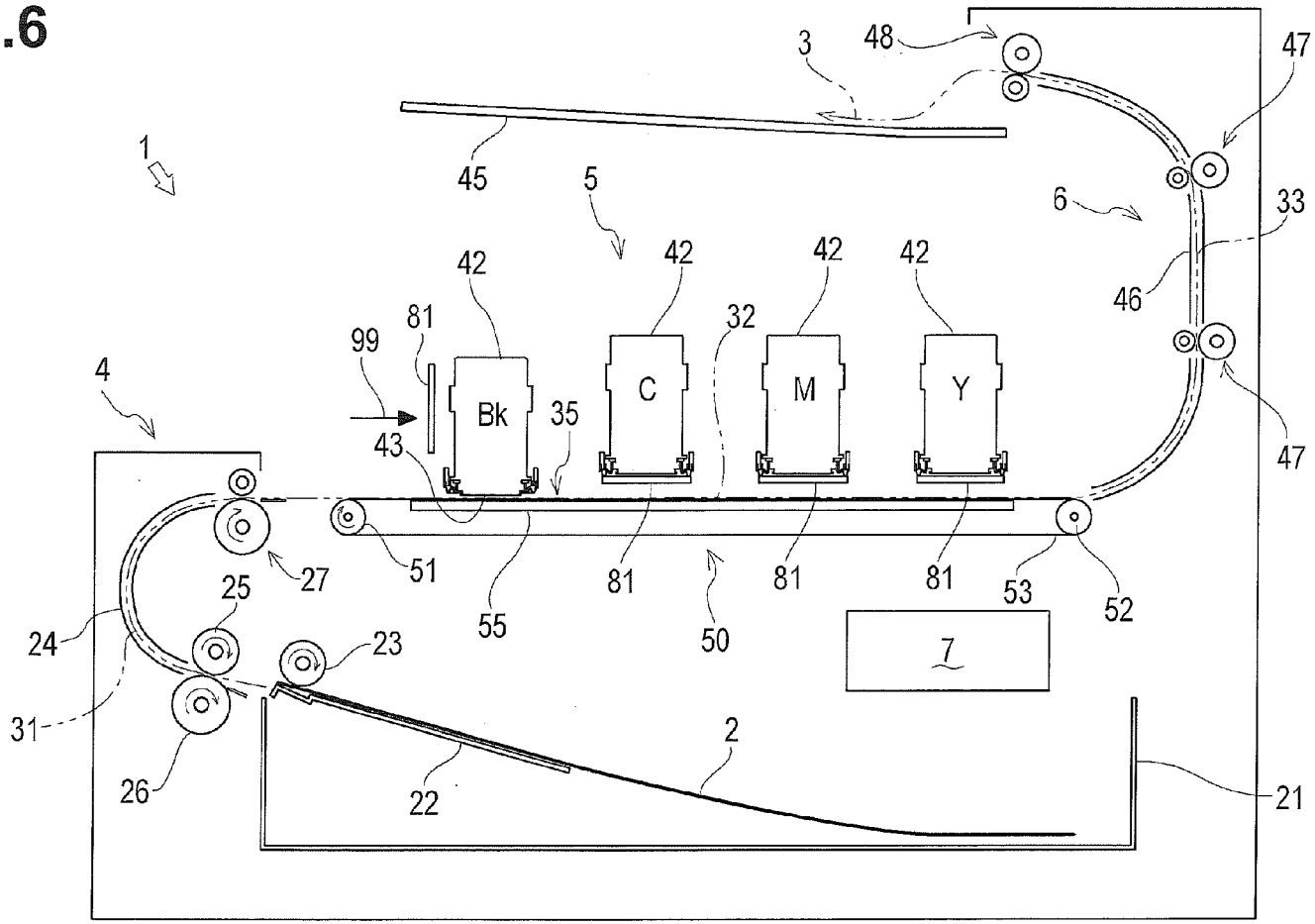
FIG. 6 is a side view that schematically illustrates the ink-jet recording apparatus when ejection surfaces of a plurality of recording heads can be individually capped.

For the ink-jet recording apparatus 1 according to the embodiment, a single set of the first wall 81 and the second wall 82 is provided to each of the recording heads 42. All the first walls 81 and the second walls 82 may be operated in synchronization with each other, or alternatively, all the first walls 81 and the second walls 82 may be operated independently. Alternatively, more than one sets of the first walls 81 and the second walls 82 may be operated in synchronization with each other. In the ink-jet recording apparatus 1 according to the embodiment, the ejection surfaces 43 of the recording heads 42 can be individually capped or uncapped. For example, as illustrated in FIG. 6, when the ink-jet recording apparatus 1 is mainly used for monochrome printing, the recording heads 42 corresponding to color inks other than black can be capped while color printing is not performed, thus enabling the state of the color inks of the recording heads 42 to be maintained satisfactorily. Referring to FIG. 6, the recording head for the black (Bk) ink is uncapped, and the recording heads for the other color inks (cyan (C), magenta (M), and yellow (Y)) are capped.

As described above, the ink-jet recording apparatus according to the embodiment is a line ink-jet recording apparatus including line recording heads. However, the ink-jet recording apparatus is not limited thereto. For example, the present invention is also applicable to an ink-jet recording apparatus including a serial recording head. When the present invention is applied to an ink-jet recording apparatus including a serial recording head, the first wall of the cap during recording may not be at a position remote from the recording head in the conveyance direction, but may be evacuated at a position remote from the recording head in a direction substantially perpendicular to the conveyance direction. The position of the cap during recording may be determined in consideration of relationship with other components with the aim of miniaturizing the apparatus.

What is claimed is:

1. An ink-jet recording apparatus comprising:

a recording head comprising an ejection surface in which an ejection port, which is configured to eject ink toward a recording medium conveyed by a conveying member in a conveyance direction, is formed;

a first wall configured to oppose the ejection surface;

a second wall configured to enclose surroundings of the ejection surface;

a first wall moving unit configured to move the first wall between a first position at which the first wall opposes the ejection surface, and is spaced apart from the ejection surface, and a second position at which the first wall does not oppose the ejection surface; and a second wall moving unit configured to move the second wall between a third position at which the second wall is in contact with the first wall positioned at the first position and a fourth position at which the second wall is not in contact with the first wall positioned at the first position and at which a distance between the second wall and the conveying member is greater than a distance between the ejection surface and the conveying member, and wherein an attitude of the first wall positioned at the second position and an attitude of the first wall at the first position are different, and wherein the first wall positioned at the first position and the second wall positioned at the third position form a closed space, which covers the ejection port.

2. The ink-jet recording apparatus according to claim 1, wherein a plane that includes the first wall positioned at the second position and a plane that includes the first wall positioned at the first position are substantially perpendicular to each other.

3. The ink-jet recording apparatus according to claim 1, wherein the first wall positioned at the second position is disposed upstream or downstream of the recording head in the conveyance direction.

4. The ink-jet recording apparatus according to claim 1, further comprising a plurality of recording heads, and wherein the plurality of recording heads are arranged in the conveyance direction, wherein each of the plurality of recording heads is a line recording head having a plurality of ink ejection ports arranged across a recording width of the recording medium, and wherein the first wall and the second wall are disposed so as to correspond to each of the plurality of recording heads.

5. The ink-jet recording apparatus according to claim 1, further comprising a control unit configured to control the first wall moving unit and the second wall moving unit such that, from a state where the first wall is positioned at the second position and the second wall is positioned at the fourth position, after the first wall reaches the first position, the second wall reaches the third position.

6. The ink-jet recording apparatus according to claim 5, further comprising a recording head moving unit configured to move the recording head toward or away from the conveying member in a plane perpendicular to the conveying member.

7. The ink-jet recording apparatus according to claim 6 wherein the control unit is configured to control the first wall moving unit, the second wall moving unit, and the recording head moving unit such that, after the first wall reaches the first position, the recording head is moved toward the conveying member, and, simultaneously or after the recording head reaches a position near to the conveying member where the first wall is allowed to be inserted therebetween, the second wall reaches the third position.

8. The ink-jet recording apparatus according to claim 1, further comprising a control unit configured to control the first wall moving unit and the second wall moving unit such that, from a state where the first wall is positioned at the first position and the second wall is positioned at the third position, after the second wall starts being moved from the third position toward the fourth position, the first wall starts being moved from the first position toward the second position.

9. The ink-jet recording apparatus according to claim 8, further comprising a recording head moving unit configured to move the recording head toward or away from the conveying member in a plane perpendicular to the conveying member, and wherein the control unit controls the first wall moving unit, the second wall moving unit, and the recording head moving unit such that the recording head starts being moved away from the conveying member simultaneously or after the second wall starts being moved from the third position toward the fourth position.

* * * * *